US009958225B1

(12) United States Patent
Richetti et al.

(10) Patent No.: US 9,958,225 B1
(45) Date of Patent: May 1, 2018

(54) TRIGGER SHIELD APPARATUS

(71) Applicant: Richetti Tactical Solutions, LLC, Ponte Vedra Beach, VA (US)

(72) Inventors: Donald Richetti, Ponte Vedra Beach, FL (US); Ryan Richetti, Ashburn, VA (US)

(73) Assignee: Richetti Tactical Solutions, LLC, Ponte Verda Beach, FL (US)

( * ) Notice: Subject to any disclaimer, the term of this patent is extended or adjusted under 35 U.S.C. 154(b) by 0 days. days.

(21) Appl. No.: 15/686,135

(22) Filed: Aug. 24, 2017

Related U.S. Application Data

(60) Provisional application No. 62/450,585, filed on Jan. 26, 2017.

(51) Int. Cl.
*F41A 17/54* (2006.01)
*F41A 17/46* (2006.01)

(52) U.S. Cl.
CPC ..... *F41A 17/54* (2013.01); *F41A 17/46* (2013.01)

(58) Field of Classification Search
CPC ..... F41A 17/46; F41A 17/54
USPC ..... 42/70.07, 70.01, 90
See application file for complete search history.

(56) References Cited

U.S. PATENT DOCUMENTS

| | | | | |
|---|---|---|---|---|
| 6,154,995 | A * | 12/2000 | Lenoir | F41A 17/06 42/70.07 |
| 8,347,539 | B2 * | 1/2013 | Burns, III | F41A 17/54 42/70.06 |
| 2011/0047849 | A1 * | 3/2011 | Brenner | F41A 17/54 42/70.07 |
| 2016/0109203 | A1 * | 4/2016 | Madia, II | F41A 17/54 42/70.07 |
| 2017/0227316 | A1 * | 8/2017 | Harper | F41A 17/54 |

* cited by examiner

*Primary Examiner* — John W Eldred
(74) *Attorney, Agent, or Firm* — Mark Wardas

(57) ABSTRACT

Shrouds for preventing unintentional engagement or initiation of firearm triggers during handling of the firearm are described.

20 Claims, 11 Drawing Sheets

900

TRIGGER SHIELD APPARATUS

CONTINUITY INFORMATION

Figure 1A:
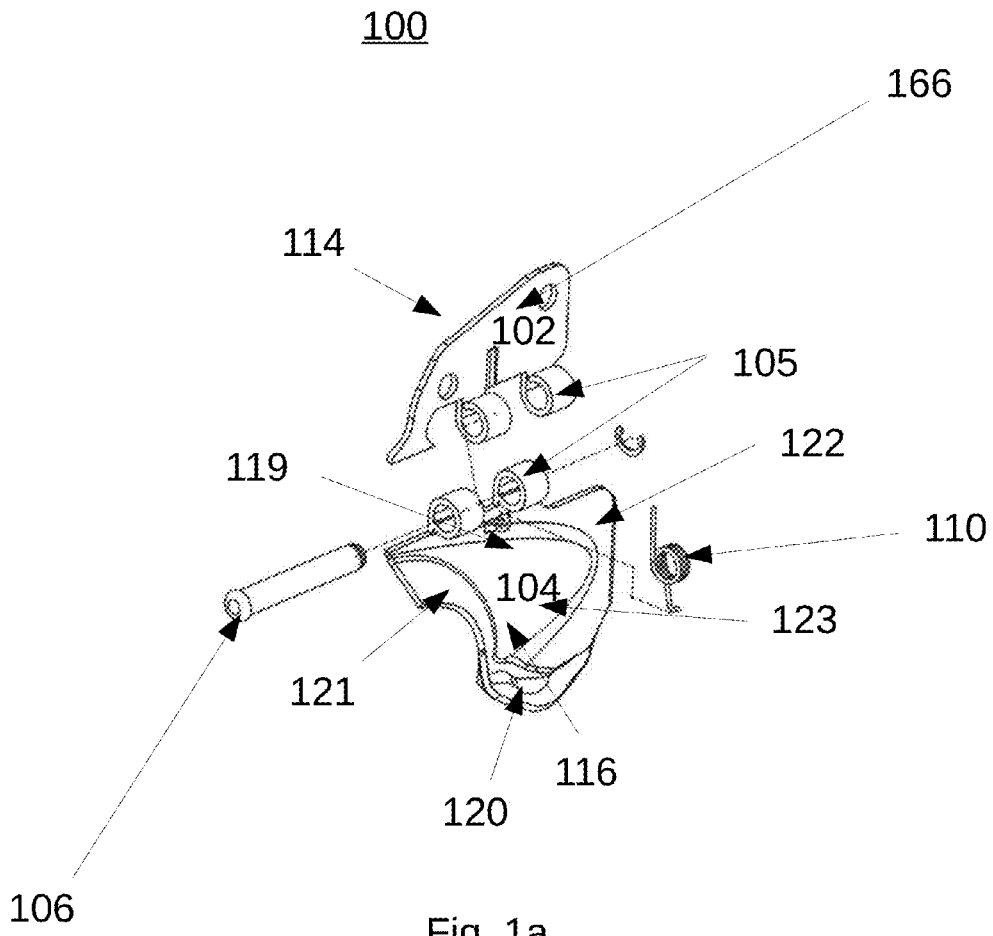

The present invention is related to and claims priority from U.S. Provisional Ser. No. 62/450,585 filed 26 Jan. 2017.

FIELD OF THE INVENTION

The present invention is directed to preventing unintentional engagement or initiation of firearm triggers during handling of the firearm.

BACKGROUND

Trigger locks are the typical way of blocking unintentional engagement or initiation of firearm triggers. While trigger locks perform their function well for their intended purpose, they are not a viable option for firearms that are intended to be used. When using firearms, the primary means that operators employ to avoid accidental or negligent discharges is by attention and a conscious or subconscious decision to not touch, engage or initiate a firearm trigger before executing the purposeful action of pulling the trigger. However, whether conscious or not, operators cannot devote all their attention to safety all the time. It has been identified that despite intensive training, even a firearm professional can actuate trigger accidently by having their attention redirected to other priorities.

It is recognized that any adequate rearward pressure of a trigger will precipitate the discharge of a firearm. To date, as firearm triggers have been designed and manufactured, there is no way for the inanimate trigger mechanism to intelligently determine whether or not the rearward force applied to it, resulting in discharge, was applied by; the operator's finger, someone else's finger or by any other intentional or unintentional means.

Currently, the only effective safety and security measures a firearm operator can take are training, familiarity with the firearm, focus, attention, sobriety and general appreciation for the inherent risk involved in operating a firearm.

Unfortunately, regardless of the level of training, focus, and attention, firearm accidents can still happen. By definition, an accident is the perpetration of a result or outcome without premeditation, intent or purposeful action. Even among those with years of experience, thousands of rounds fired in training or otherwise, accidental or negligent discharges of a firearm still pose a clear and present danger.

Most modern-day firearms include an external "safety" designed to impede an operator from accidentally discharging his/her firearm before purposefully meaning to do so. However, an external safety is an "actively engaged" mechanism that must be initiated by the operator to be of any value. When a firearm operator either neglects or chooses not to engage the safety, its benefit becomes null and void. Disengagement of the safety takes time, which in an immediate or anticipated live fire situation can mean the difference between life and death. Thus, in such situations, professional operators of firearms often disengage the safety prior to actively engaging a target.

With the safety disengaged, professional firearm operators are trained to use a backup safety procedure known as the "finger forward" position. Unfortunately the finger forward position cannot always be relied upon, as it does not prevent an operator and/or ambient material (other people, gear, branch, etc.) from accessing the trigger during periods of inattentiveness or by accident.

Therefore, what is needed is a new solution by which use of firearms can be made safer without impediment to the efficiency with which they may be intentionally operated or without making them impractical to use.

FIGURES

Figure 1B:
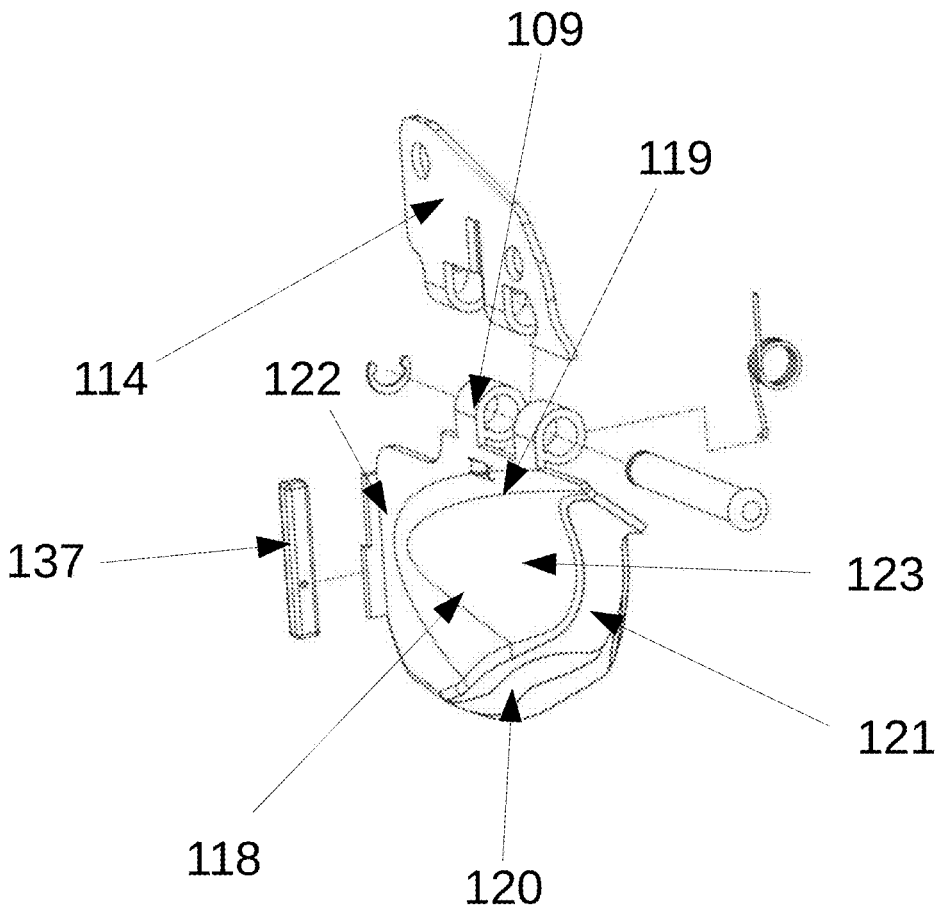

Referring now to FIG. 1*a-b*, there is seen a front side perspective and backside perspective representation of a shroud according to the present invention.

Figure 2:
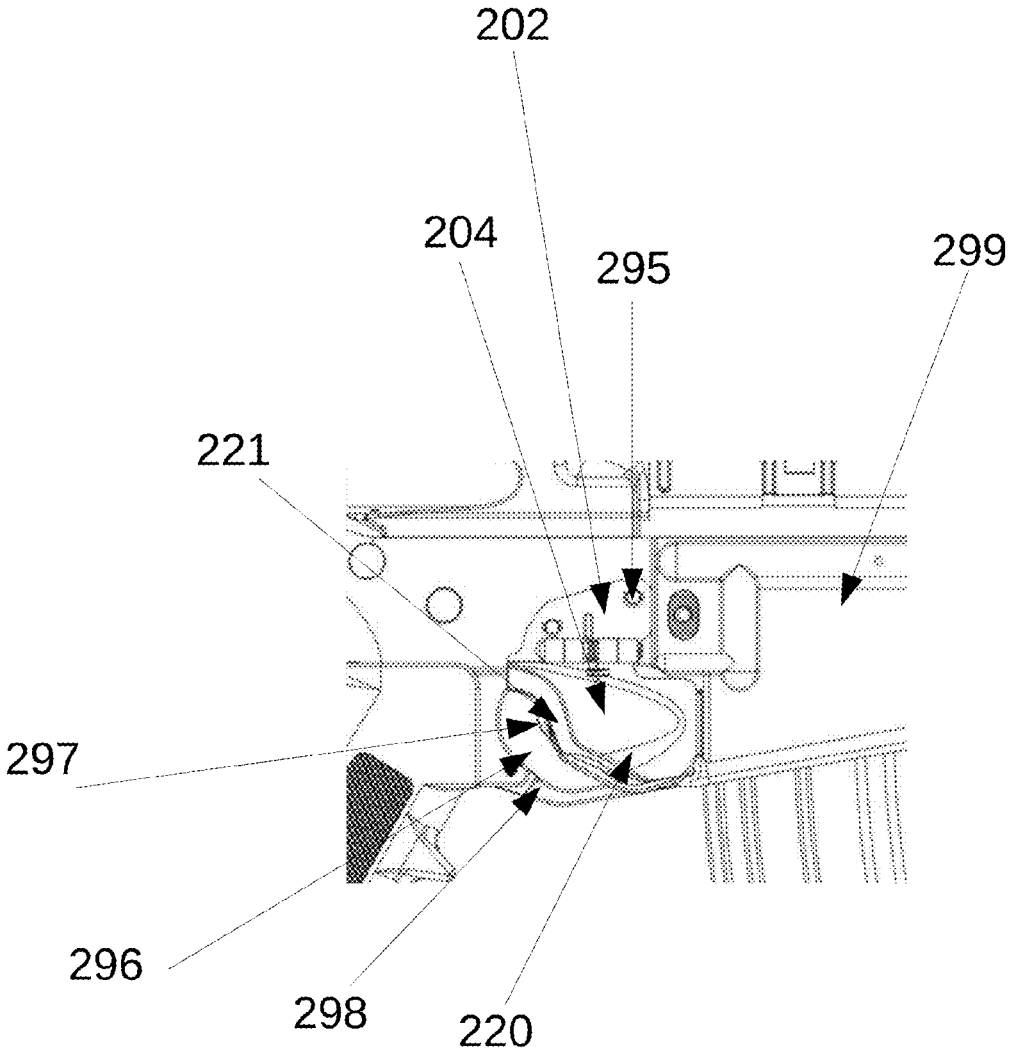

Referring to FIG. 2, there is seen a right side view representation of a shroud mounted on a firearm and in a closed position.

Figure 3:
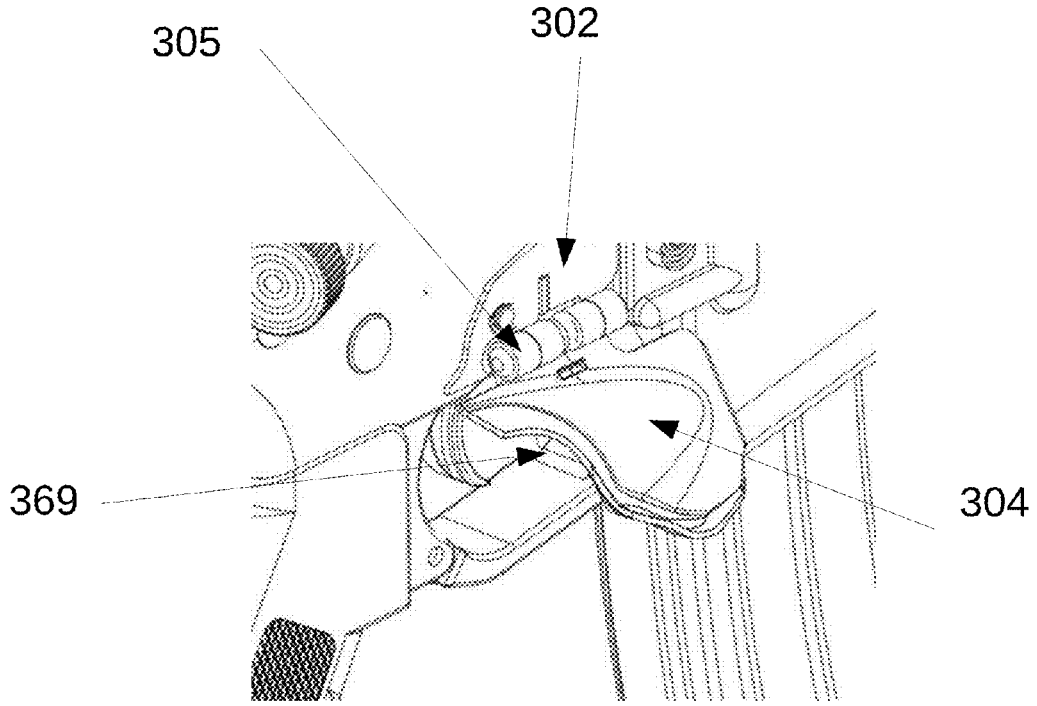

Referring to FIG. 3, there is seen a right side view representation of a shroud mounted on a firearm and in an open position.

Figure 4A:
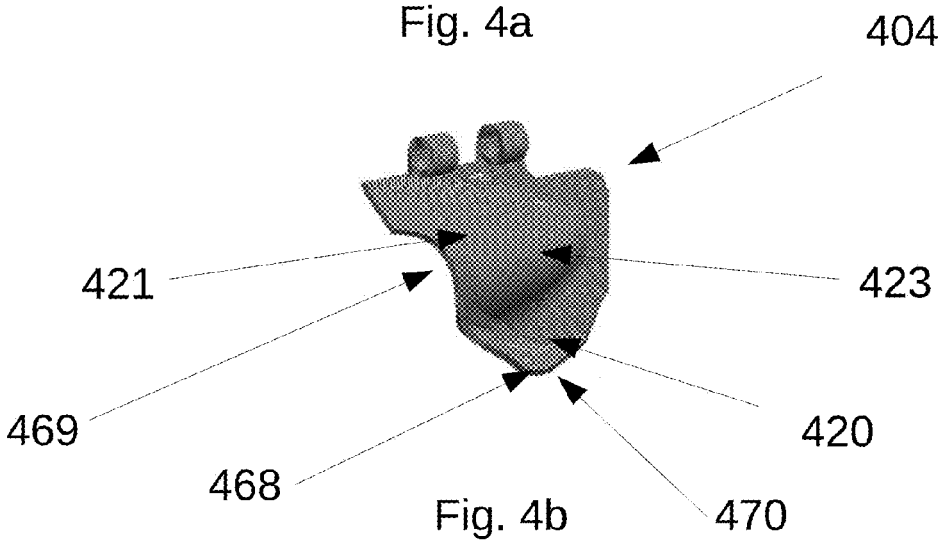
Figure 4B:
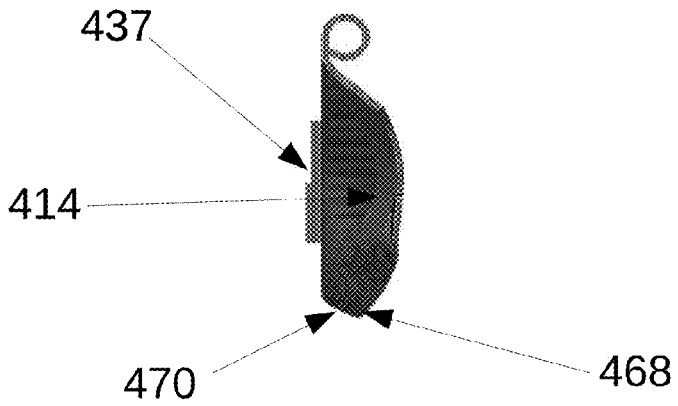
Figure 4C:
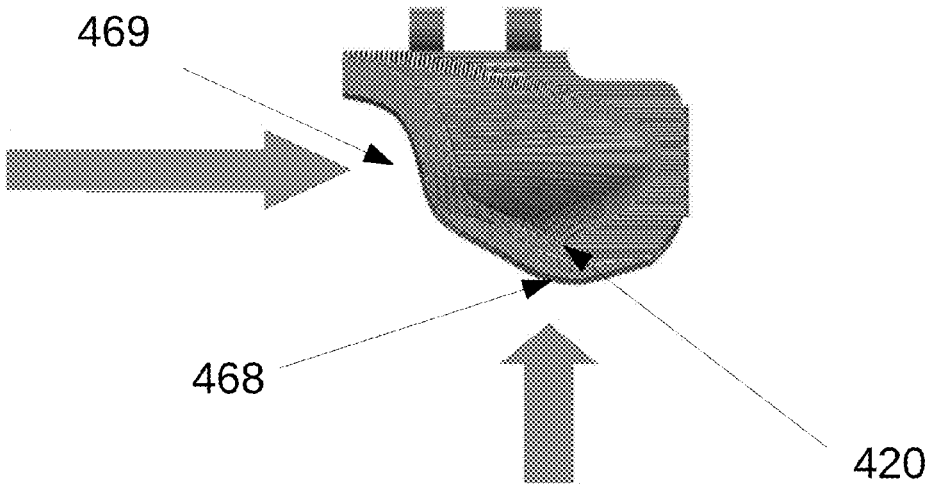

Referring to FIG. 4*a-c*, there is seen a front perspective, side, and front representation of a finger shield.

Figure 5:
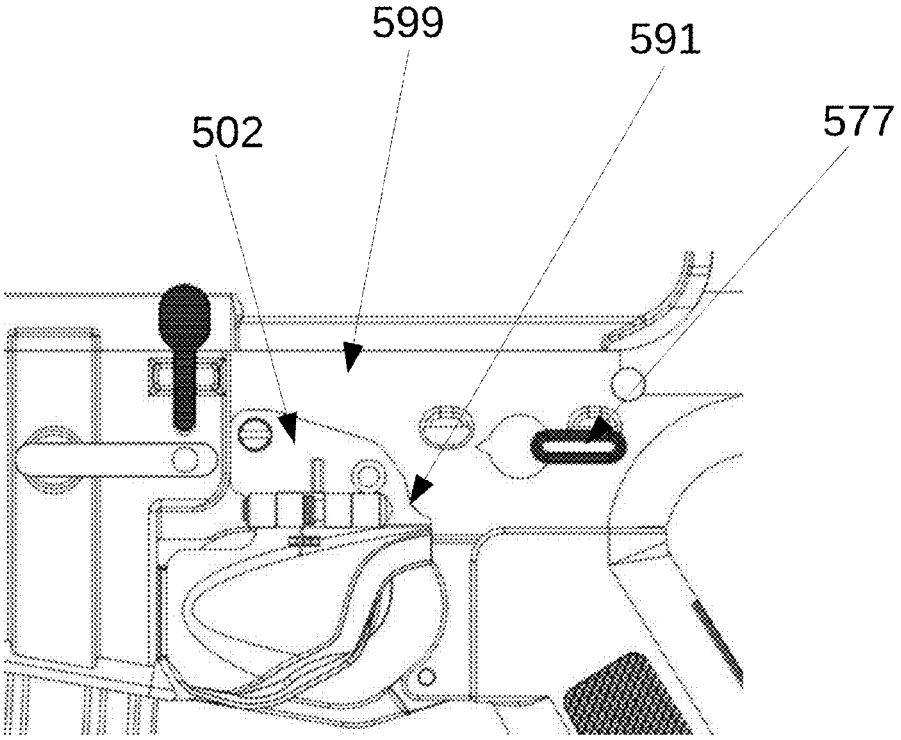

Referring to FIG. 5, there is seen a left side view representation of a second shroud mounted on a firearm and in a closed position.

Figure 6:
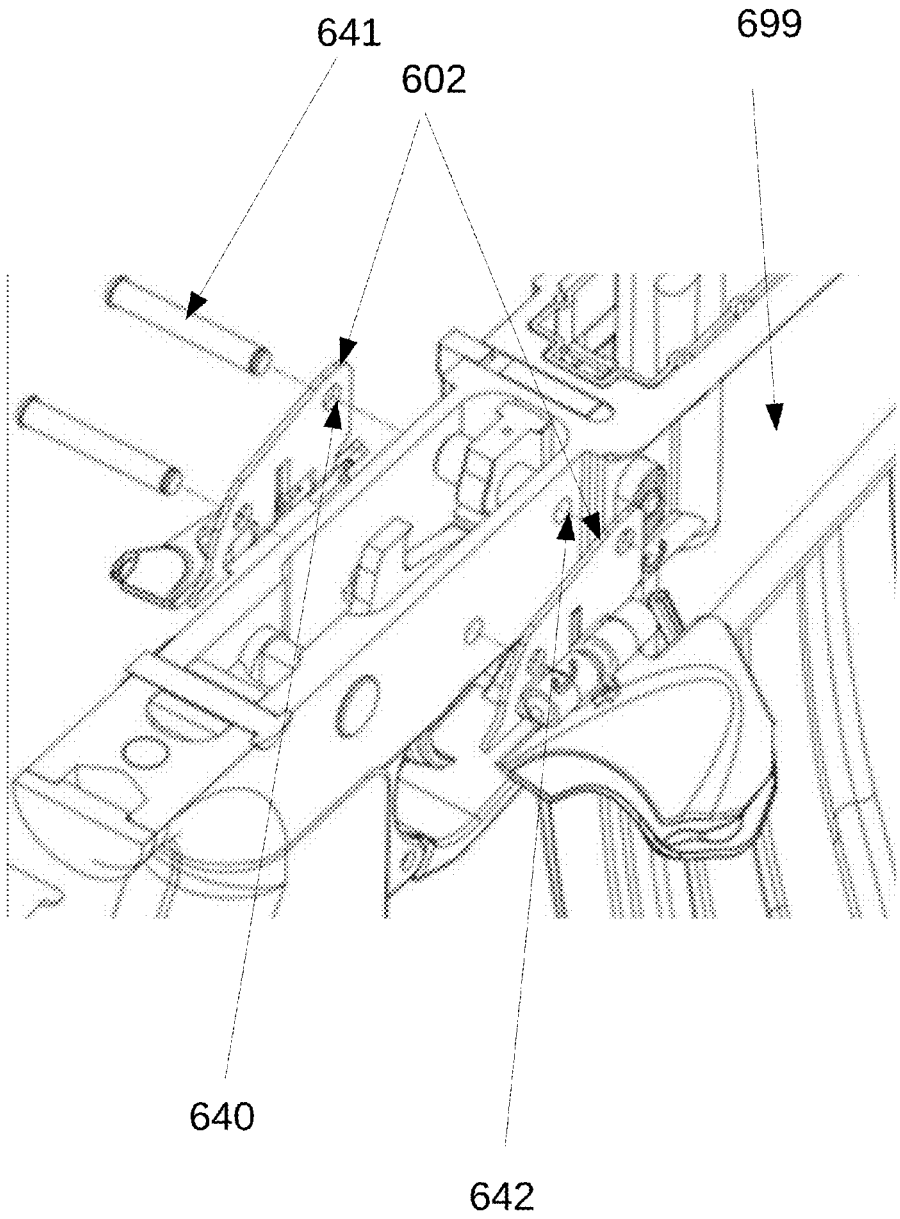

Referring to FIG. 6, there is seen an exploded perspective representation of fasteners used to secure two shrouds to a firearm.

Figure 7:
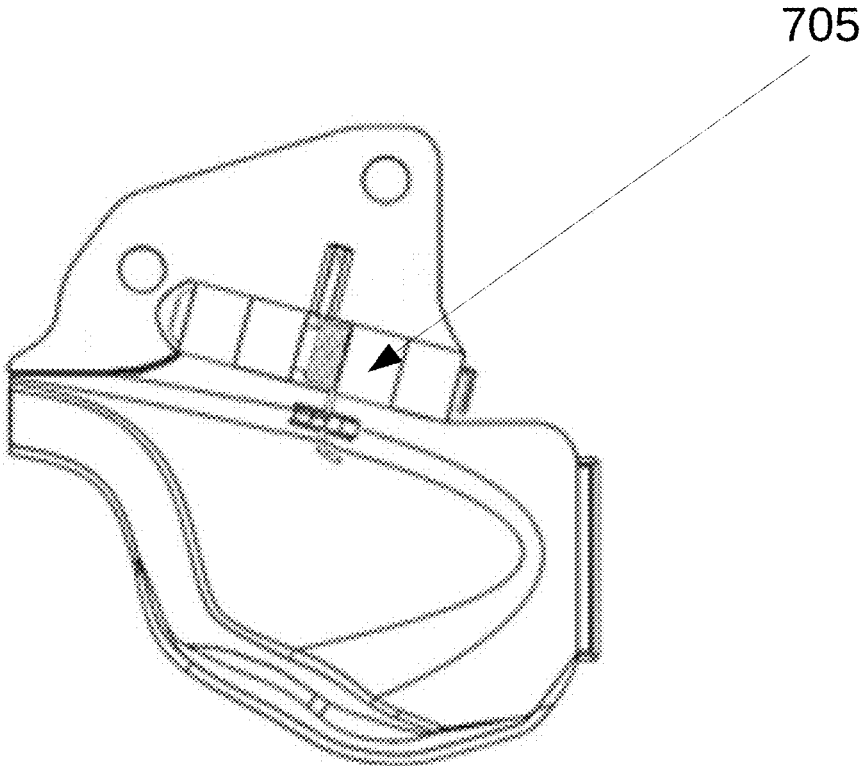
Figure 8A:
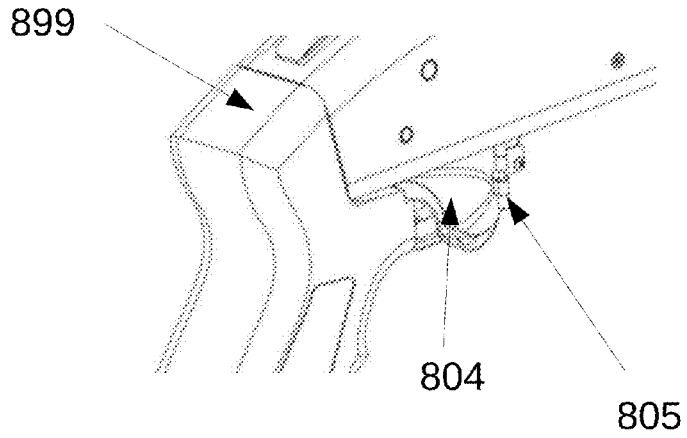
Figure 8B:
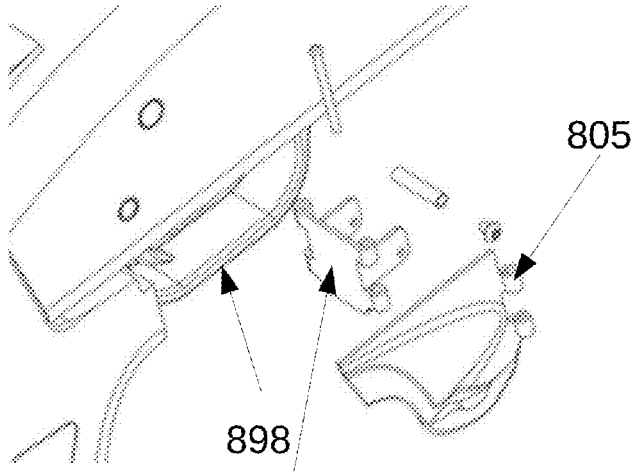
Figure 8C:
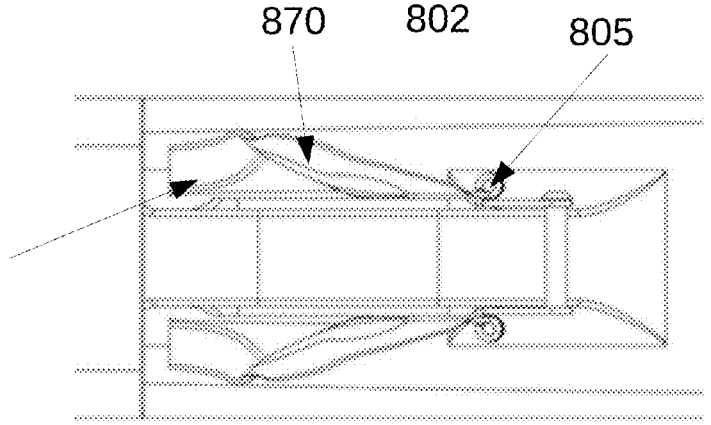

Referring to FIG. 7, there is seen a right side view representation of a hinge orientated in a longitudinal angled orientation Referring to FIGS. 8*a-c*, there is seen a right side view perspective, exploded, and bottom view representation of a shroud with a vertical hinge.

Figure 9A:
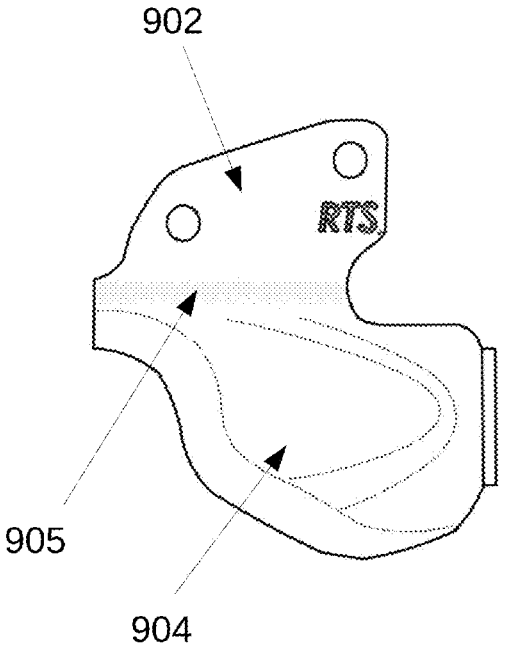
Figure 9B:
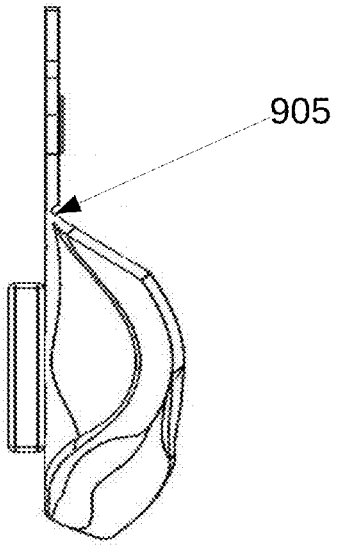

Referring to FIGS. 9*a-b*, there is seen a front and side view representation of a shroud formed to comprise a living hinge.

Figure 10A:
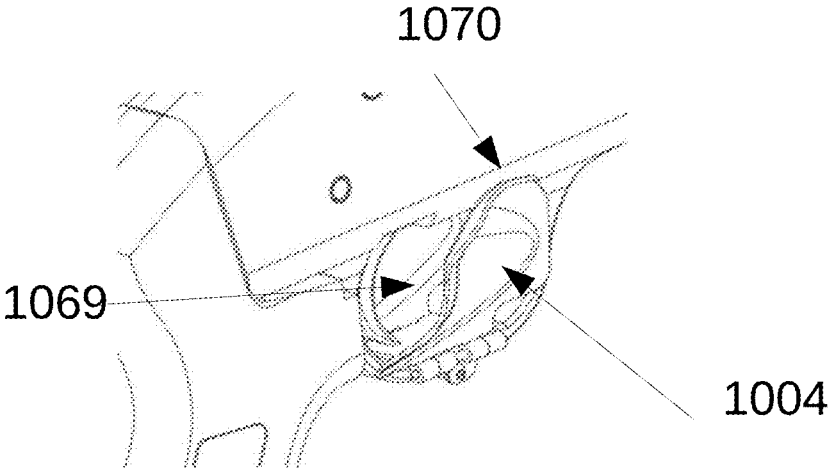
Figure 10B:
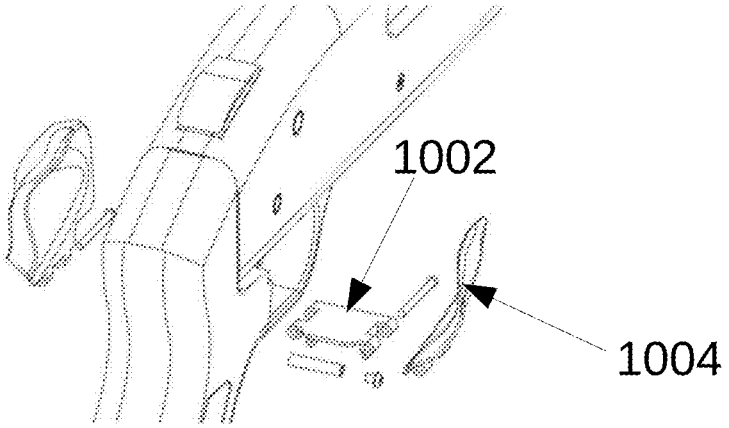

Referring to FIGS. 10*a-b*, there is seen a right side view representation of a shroud mounting on a firearm with a second opening formed at a top of a finger shield and an exploded perspective view of the shroud for mounting to a trigger guard of a firearm.

SUMMARY

The present invention provides a function and level of safety and mitigation against the accidental, negligent or otherwise unintentional discharge of a firearm that, once properly applied to the weapon, executes its function without requiring action by an operator. The present invention is designed to provide its intended benefit of inherent safety at all times, except when actively bypassed.

The present invention comprises a shroud that shields a firearm trigger from inadvertent or accidental breach of the trigger well by a trigger finger or by other means. The shroud is configured to remain closed by gravity and/or downward spring pressure or to be opened by purposeful action of a firearm operator. In doing so, the present invention encumbers access to the trigger well for the purpose of preventing the trigger from being touched or pulled unintentionally, yet allows quick intentional access to the trigger when needed.

The present invention provides multiple modalities by which a trigger may be quickly accessed and yet accidental activation of the trigger is minimized. The multiple safety and protective characteristics of the present invention are relevant and not redundant because their design and utility allows for ergonomic, easy and quick purposeful access into the trigger well and onto a trigger when necessary.

The present invention does not substantially impede "quick" access to the trigger as may be necessary in a combat environment. In fact, when familiar with the function of the shroud, its deployment can shave milliseconds off an operator's reaction time compared to manually disengaging a safety when in a necessarily reactive shooting scenario.

In one embodiment the present invention comprises: a shroud configured to prevent inadvertent insertion of an operator's finger into a trigger well of a firearm, the shroud comprised of: a mount; a finger shield comprised of an inner surface and an outer surface; and a hinge coupled to and disposed between the mount and the finger shield, wherein the inner and outer surfaces of the finger shield define a top region, a bottom region, a front region, and a rear region, wherein with the mount coupled to the firearm the finger shield in part defines two openings configured to guide a length of the operator's finger into the trigger well. In one embodiment the two opening are in part defined by contours formed along inner surfaces of the finger shield in the rear region and the bottom or top region. In one embodiment wherein insertion of a finger in each opening the hinge is biased into a closed position by a biasing mechanism. In one embodiment with the mount coupled to the firearm and upon insertion of the person's finger into each of the openings, the hinge is configured to rotate about an axis. In one embodiment the axis comprises a longitudinal axis, and with the mount coupled to the firearm the longitudinal axis is parallel to a barrel of the firearm. In one embodiment the axis comprises a longitudinal axis, and wherein with the mount coupled to the firearm the longitudinal axis is not parallel to the barrel. In one embodiment the shroud comprises a first and second finger shield. In one embodiment the mount is configured with mounting apertures that correspond to apertures of the firearm. In one embodiment the mount is configured to be mounted to locations on the firearm selected from the group consisting of: a stock, a frame, a grip, a handle, and a trigger guard.

In one embodiment, the present invention comprises: a shroud configured to be used by an operator of a firearm comprised of a barrel that defines a longitudinal direction, the shroud comprising: a mount; and a finger shield coupled to the mount and configured to cover at least a portion of a right or left side of the trigger well of the firearm, wherein with the shroud coupled to the firearm a periphery of the finger shield in part defines a first opening, wherein upon insertion of the operator's finger into the first opening the finger shield is configured to rotate into an open position about a longitudinal axis. In one embodiment the first opening is defined in part by an inner surface of the finger shield along a rear of the finger shield. In one embodiment a periphery of the shroud in part defines a second opening, wherein upon insertion of the operator's finger into the second opening and with the mount coupled to the firearm the finger shield is configured to rotate into an open position about the longitudinal axis. In one embodiment the shroud comprises a hinge, wherein the hinge couples the mount to the finger shield along the axis. In one embodiment the second opening is defined by a top of the periphery or the bottom of the periphery.

In one embodiment, the present invention comprises a firearm, comprised of: a barrel that defines a longitudinal direction; a trigger; a trigger well; and a shroud comprised of a finger shield that covers the trigger well, a mount, and a hinge coupled to and disposed between the mount and the finger shield, wherein the finger shield is mounted to the firearm by the mount, and wherein the finger shield is rotatable with respect to the mount about a longitudinal axis. In one embodiment the mount comprises a fastener selected from the group consisting of a pin, adhesive, solder, a magnet, a clip, a clamp, a wrap, a rail. In one embodiment the hinge comprises a living hinge. In one embodiment a periphery of the finger shield is contoured to in part define at least one opening within which a longitudinal length of an operator's trigger finger is capable of being inserted to cause rotation of the shroud about the longitudinal axis. In one embodiment the at least one opening is defined by a bottom peripheral surface of the finger shield. In one embodiment the firearm comprises an M4 style firearm, and wherein the mount is configured to be coupled to the M4 style firearm via pins inserted into preexisting holes of a lower receiver of the firearm. In one embodiment the at least one opening comprises two different openings defined by peripheral surfaces of the finger shield that face the firearm.

In one embodiment, the present invention comprises a method of mounting an accessory device to a firearm, comprising removing a securing pin from an aperture in the firearm, the securing pin having a length; replacing the one more securing pin with a securing pin having a longer length; inserting the securing pin having the longer length into the aperture; and using the longer length of the pin to secure the accessory device to the firearm. In one embodiment, the method further comprises inserting the securing pin through the aperture in the firearm and an aperture in the accessory device. In one embodiment, the firearm comprises an M4 style weapon having M4 style apertures.

DETAILED DESCRIPTION

Referring now to FIG. 1*a-b*, there is seen a front outside perspective and back inside perspective representation of a shroud according to an embodiment of the present invention.

In one embodiment, shroud 100 comprises a mount 102, a finger shield 104, and a hinge portion 105. Hinge portion 105 couples mount 102 to finger shield 104. Mount 102 comprises a front side 166 and a back side 114, where the back side is configured to be mounted to a firearm. Finger shield 104 comprises a front side 116, a back side 118 configured to face a trigger and trigger well of the firearm when the mount 2 is mounted to the firearm, and a periphery comprised of a top region 119, a bottom region 120, a rear region 121, a front region 122, and a middle region 123. Hinge portion 105 comprises structures 109 that enables finger shield 104 to rotate with respect to mount 102. In one embodiment, the structures 109 mate with each other and are held together via insertion of the one or more rod or pin 106 into apertures formed in structures 109. In one embodiment, shroud 100 also comprises a biasing mechanism 110. In one embodiment the biasing mechanism comprises a torsion spring. In one embodiment, biasing mechanism 110 is restrained by mount 102 and delivers light downward pressure to finger shield 104 to keep the finger shield 104 in a closed position and to prevent it from flapping naturally during typical movements of the firearm, such as when carried. In one embodiment, finger shield 104 also comprises a riser 137 that is coupled to the finger shield or that is formed integrally with the finger shield.

Shroud 100 may be manufactured by machining, injection molding, cutting or other manufacturing techniques known to those skilled in the art. Characteristics that can be used for selection of the material for the shroud include, but are not limited to: durability, rigidity, weight, waterproof, rustproof, and smoothness. Some materials contemplated for manufacture of the shroud 100 include, but are not limited to: plastic, metal, kevlar, acrylic, kydex, leather, rubber and combinations thereof. In one embodiment, rod or pin 106 and biasing mechanism 110 are manufactured from a metal or other durable material capable of performing their intended function over many cycles of use.

Referring to FIG. 2, there is seen a right side view representation of a shroud mounted on a firearm and in a closed position. Although the particular firearm 299 represented in FIG. 2 illustrates a shroud mounted on the right side of an M4-style rifle, with appropriate changes in geometry and orientation, it should be appreciated that shroud is capable of being configured to fit on other firearm makes and models (rifles, shotguns, pistols, revolvers, etc.) and different firearm mounting locations (see FIG. 7 below). In the orientation of FIG. 2, shroud is configured so that in a typical "finger forward" position of use, an operator's finger can comfortably rest on top and along the bottom region 220 of the front side of finger shield 204.

Firearm 299 is representative of most firearms in that it comprises a trigger guard 298, a trigger 297, a trigger well 296, and a mounting location 295. In the case of the firearm 299 of FIG. 3, the mounting location where mount 202 of the shroud is mounted is a lower receiver. In one embodiment, when mounted to firearm 299 and when viewed from the right side of the firearm, trigger shield 204 covers a portion of the trigger well 296 and trigger 297. In other embodiments, as long as accidental and/or negligent access to the trigger well and thus the trigger as discussed herein is prevented and/or reduced, a trigger shield could be dimensioned to cover more or less of the trigger well, for example to completely cover the trigger well. In one embodiment, when a shroud is mounted to a firearm, rear region 221 defines at least part of a first opening that is formed between trigger well 296 and the finger shield 204. In one embodiment, when a shroud according is mounted to a firearm, a bottom region 220 of the shroud defines a second opening between trigger well 296 and the finger shield. In one embodiment, the back side surface 214 of the finger shield 204 in the rear region 221 is contoured and curved to point away from the firearm such that it in part defines the first opening. As will be seen further below, the back side surface 214 of the finger shield 204 is also contoured and curved to in part define the second opening. In one embodiment, bottom region 220 is spaced apart from trigger guard 298 by a small distance to define the second opening. This distance allows for easier and smoother access to the trigger well by gloved or ungloved fingers.

Referring to FIG. 3, there is seen a right side view representation of a shroud mounted on a firearm and in a partially open position. In an embodiment of use, where finger shield 304 is initially in the closed position shown in FIG. 2, and an operator's finger is held in a "finger forward" position on top and along an external contoured surface along bottom region (see 220 in FIG. 2) of the finger shield 304, it is identified that a finger's unintentional access to a trigger will be blocked, or at a minimum hindered, by the finger shield. To achieve access to the trigger, it is identified that finger shield 304 needs to be rotated about hinge 305 with respect to mount 302 in a manner as represented by FIG. 3.

Referring to FIG. 4*a-c*, there is seen a front perspective, side, and front representation of a finger shield. In one embodiment, bottom region 420 of a finger shield 404 includes an outer facing lip 468 that defines a contoured and curved wall between a bottom region 420 and middle region 423. In one embodiment, an exterior of the curved wall between the bottom region and the middle 423 defines a depression that is ergonomically contoured to accept an extended operator's finger along its surface in a finger forward position. In an embodiment of use with a firearm as shown in FIG. 3, from a finger forward position, an operator can access a trigger well and trigger via a downward movement of their extended finger along the contoured surface at the bottom region 420 to below the lip 468, and then via an upward movement of the extended finger underneath the lip into a space between the lip and the trigger guard and then further into the trigger well and onto the trigger (see upward movement represented by vertical arrow in FIG. 4*c*), where after having performed the movements, finger shield 404 will be in the open position represented by FIG. 3.

The rear region 421 of the finger shield 404 is also contoured and curved to accept the operator's trigger finger via insertion under the back side along the periphery at the rear region. The curved contour defines at least part a first opening 469 under the rear region that, when mounted to a firearm, is contoured away from the firearm to accept insertion of an operator's finger via retraction of the finger backward from the finger forward position and then via forward movement into the opening 469 and along the back side 414 of finger shield 404 (see forward movement represented by horizontal arrow in FIG. 4*c*). In one embodiment, the middle region 423 of the finger shield 404 is also configured to facilitate further insertion of the finger into the trigger well. In one embodiment, middle region is defined by a countered inner and outer surface.

In one embodiment, lip 469 is held and spaced apart from a trigger well by a small distance to define at least part of a second opening 470. In one embodiment, the spacing is maintained by riser 437 that extends at a perpendicular angle to the back side 414. In one embodiment, with the finger shield 404 mounted to a firearm, the function of the riser 437 acts as a spacer that holds the finger shield 404 slightly away to create opening between the edge of the finger shield 404 and a trigger guard of the firearm it will be mounted above.

Referring to FIG. 5, there is seen a left side view representation of a second shroud mounted on a firearm and in a closed position. In one embodiment, the present invention comprises a second shroud mounted on the left side of a firearm 599. The second shroud is configured to provide same functionality as the shroud described above, but with its shape and structure adapted to function on the left side of firearm 599, see for example where periphery at 591 of a mount 502 is contoured to allow a safety 577 to be rotated between an armed, disarmed, and select fire position. In embodiments, the second shroud can be used alone or in combination with the shroud described above.

Referring to FIG. 6, there is seen an exploded perspective representation of fasteners used to secure two shrouds to a firearm. In one embodiment, each mount 602 comprises one or more aperture 640 configured to receive a fastener 641. In one embodiment, apertures 640 are formed in the mount 602 with dimensions that that enable the apertures to be aligned to preformed holes 642 of an upper receiver of firearm 699, for example, preformed holes that are used to receive pre-existing pins that hold a trigger and hammer mechanism in position on the receiver. In an embodiment of use, the pre-existing pins of the firearm are removed, one or both mounts and their apertures are aligned to the preexisting holes 642, and the pins 641 are inserted into the apertures 640 and the preformed holes 642 to hold the mounts 602 and the trigger mechanism in position.

The present invention identifies that not all firearms have conveniently formed preformed holes that can be used in the manner discussed above and contemplates that other firearms may require attachment of the present invention by other methods and in other locations on the firearm. For example, in embodiments, it is contemplated that one or both mounts 602 could be attached to a firearm via adhesive, magnets, soldering, clips, clamps, wraps, tension, picatinny or other standardized attachment rail configuration designed to accept attachment and removal. Further, with appropriate modification made to mount 602, it is contemplated that one or both shrouds could be mounted on firearms in other orientations and other locations near or next to the trigger, for example, a stock, a frame, a grip, a handle, or a trigger guard (see FIG. 8).

Whether used with one or two shrouds, the present invention identifies that in the event that debris become lodged in a trigger well of firearm 699, the debris can easily be removed by lifting at least one shroud and pushing the debris out of the trigger well.

Referring to FIG. 7, there is seen a right side view of a hinge orientated in a longitudinal angled orientation. With reference to FIG. 2 above, there is seen that hinge 205 defines an axis about which finger shield 204 rotates with respect to the mount 202. In the embodiment of FIG. 2, it is identified that an axis about which finger shield rotates will be generally parallel to a barrel of the firearm 299. In another embodiment, it is identified that hinge 705 may be oriented in an orientation other than parallel to that of a barrel of a firearm, for example at an angle as represented in FIG. 7. It is identified that non-parallel hinge orientations may be required by a particular firearm geometry or may be preferred by some operators that have particular hand or finger geometries unable to accommodate a parallel orientation.

Referring to FIGS. 8*a-c*, there is seen a right side view perspective, exploded, and bottom representations of a shroud with a vertical hinge. In one embodiment, a shroud is configured for mounting to a firearm with a hinge 805 in an orientation other than parallel to a barrel of a firearm, for example, with an orientation that enables rotation about an axis that is longitudinal but not parallel to a barrel. In one embodiment, hinge 805 is oriented to rotate about a generally vertical axis relative to a barrel of a firearm 899. In one embodiment as seen in FIGS. 8*a-b*, a mount 802 of shroud is configured to be coupled to and against a trigger guard 898. With reference to the bottom view in FIG. 8*c*, when mounted to the firearm 899, inner surfaces of finger shield 804 define a first opening 869 and a second opening 870 as discussed in other embodiments above.

Referring to FIGS. 9*a-b*, there is seen a front and side view representation of a shroud formed to comprise a living hinge. With reference to the shroud described in FIG. 1 above, a hinge 105 was described to comprise structures 109, pin 106, apertures 124, and a biasing mechanism 110. With reference to FIGS. 9*a-b*, in one embodiment a shroud 900 is formed from one piece of material, and comprises a mount portion 902, a finger shield portion 904 and a hinge potion 905 disposed therebetween. In one embodiment, hinge portion 905 comprises a thinned region formed in shroud 900, where the thinned region is configured to act as a "living hinge". In an exemplary embodiment, where shroud 900 is manufactured of a flexible material, for example, plastic or leather, hinge portion 905 enables flexure to enable rotation of finger shield portion 904 about the hinge with respect to mount portion 902. With appropriate thinning and selection of material the living hinge is able to provide rotation about its axis while at the same time, by virtue of at least some inherent stiffness in the material, self-biasing of the finger shield 904 of the shroud to keep it in a normally closed position.

Referring now to FIGS. 10*a-b*, there is seen a right side view representation of a shroud mounting on a firearm with a second opening formed at a top of a finger shield and an exploded perspective view of the shroud for mounting to a trigger guard of a firearm. With reference to the previous embodiments discussed above, a shroud has been described with reference insertion of a finger under the shroud from the bottom and from the rear. FIGS. 10*a-b* show another embodiment, where a shroud is configured to accept a finger from the rear and into an first opening 1069 and from the top into a second opening 1070 defined at least in part by the inner surface of the shroud along the periphery of the shroud at its rear and top. As seen in FIG. 10*b*, in one embodiment, mount portion 1002 of the shroud is configured to be mounted to a trigger guard.

The invention claimed is:

1. A shroud configured to prevent inadvertent or negligent insertion of an item or an operator's finger into a trigger well of a firearm, the shroud comprised of: a mount; a finger shield comprised of an inner surface and an outer surface; and a hinge coupled to and disposed between the mount and the finger shield, wherein the inner and outer surface of the finger shield define a top region, a bottom region, a front region, and a rear region, wherein with the mount coupled to the firearm the inner surface of the finger shield in part defines two openings configured to guide a length of the person's finger into the trigger well.

2. The shroud of claim 1, wherein the two opening are in part defined by contours formed along the inner surface of the finger shield in the rear region, and the bottom region or the top region.

3. The shroud of claim 2, wherein without insertion of a finger in the two openings the hinge is biased into a closed position by a biasing mechanism.

4. The shroud of claim 2, wherein with the mount coupled to the firearm and upon insertion of the person's finger into each of the openings the hinge is configured to rotate about an axis.

5. The shroud of claim 4, wherein the axis comprises a longitudinal axis, and wherein with the mount coupled to the firearm the longitudinal axis is parallel to a barrel of the firearm.

6. The shroud of claim 4, wherein the axis comprises a longitudinal axis, and wherein with the mount coupled to the firearm the longitudinal axis is not parallel to the barrel.

7. The shroud of claim 1, wherein the shroud comprises a first and second finger shield, wherein the first finger shield is configured to be mounted on a right side of the firearm and the second finger shield is configured to be mounted on a left side of the firearm.

8. The shroud of claim 1, wherein the mount is configured with mounting apertures that correspond to apertures of the firearm.

9. The shroud of claim 1, wherein the mount is configured to be mounted to locations on the firearm selected from the group consisting of: a stock, a frame, a grip, a handle, and a trigger guard.

10. At least one shroud configured to be used by an operator of a firearm, the shroud comprising: a shroud configured to prevent inadvertent insertion of an operator's finger into a trigger well of a firearm, the shroud comprised of: a mount; a finger shield comprised of an inner surface and an outer surface; and a hinge coupled to and disposed between the mount and the finger shield, wherein the inner and outer surfaces of the finger shield define a top region, a bottom region, a front region, and a rear region, wherein with the mount coupled to the firearm the finger shield in part defines two openings configured to guide a length of the operator's finger into the trigger well.

11. The shroud of claim 10, wherein the first opening is defined in part by an inner surface of the finger shield located along a rear of the finger shield.

12. The shroud of claim 11, wherein a periphery of the shroud in part defines a second opening, wherein upon insertion of the operator's finger into the second opening and with the mount coupled to the firearm the finger shield is configured to rotate into an open position about the longitudinal axis.

13. The shroud of claim 11, further comprising a hinge, wherein the hinge couples the mount to the finger shield along the axis.

14. The shroud of claim 12, wherein the second opening is defined in part by a top of the periphery or the bottom of the periphery.

15. A firearm, comprised of:

a barrel that defines a longitudinal direction;

a trigger;

a trigger well; and a shroud comprised of a finger shield that covers the trigger well, a mount, and a hinge coupled to and disposed between the mount and the finger shield, wherein the finger shield is mounted to the firearm by the mount, and wherein the finger shield is rotatable about a longitudinal axis with respect to the mount.

16. The firearm of claim 15, wherein the mount comprises a fastener selected from the group consisting of a pin, adhesive, solder, a magnet, a clip, a clamp, a wrap, a rail.

17. The firearm of claim 15, wherein the hinge comprises a living hinge.

18. The firearm of claim 15, wherein a periphery of the finger shield is contoured to in part define at least one opening within which a longitudinal length of an operator's trigger finger is capable of being inserted to cause rotation of the shroud about the longitudinal axis.

19. The firearm of claim 18, where the at least one opening comprises two different openings defined by peripheral surfaces of the finger shield that face the firearm.

20. The firearm of claim 15, wherein the firearm comprises an M4 style firearm, and wherein the mount is configured to be coupled to the M4 style firearm via pins inserted into preexisting holes of a lower receiver of the firearm.

* * * * *